US007770627B2

(12) United States Patent
Wang et al.

(10) Patent No.: US 7,770,627 B2
(45) Date of Patent: Aug. 10, 2010

(54) VENTING ASSEMBLY FOR A CASTING MOULD

(75) Inventors: Laihua Wang, Ivanhoe (AU); Gary Savage, Carnegie (AU); Kevin Rogers, Camberwell (AU); Vu Nguyen, Braybrook (AU)

(73) Assignee: Cast Centre Pty Ltd, Saint Lucia (AU)

( * ) Notice: Subject to any disclaimer, the term of this patent is extended or adjusted under 35 U.S.C. 154(b) by 779 days.

(21) Appl. No.: 10/574,384

(22) PCT Filed: Sep. 17, 2004

(86) PCT No.: PCT/AU2004/001266

§ 371 (c)(1),
(2), (4) Date: Mar. 2, 2007

(87) PCT Pub. No.: WO2005/030413

PCT Pub. Date: Apr. 7, 2005

(65) Prior Publication Data

US 2008/0041550 A1 Feb. 21, 2008

(30) Foreign Application Priority Data

Oct. 1, 2003 (AU) ..... 2003905353

(51) Int. Cl.
*B22D 17/20* (2006.01)
*B29C 33/10* (2006.01)

(52) U.S. Cl. ..... 164/305; 164/410; 249/141; 425/812

(58) Field of Classification Search ..... 164/305, 164/410; 249/141; 425/812
See application file for complete search history.

(56) References Cited

U.S. PATENT DOCUMENTS

| | | | | | |
|---|---|---|---|---|---|
| 3,006,043 | A * | 10/1961 | Goldhamer | ..... | 164/4.1 |
| 4,577,670 | A | 3/1986 | Moore | | |
| 5,586,596 | A | 12/1996 | Freeman | | |
| 5,913,355 | A * | 6/1999 | Muramatsu | ..... | 164/305 |
| 5,913,356 | A * | 6/1999 | Muramatsu | ..... | 164/305 |
| 6,425,433 | B1 * | 7/2002 | Hayes | ..... | 164/305 |

FOREIGN PATENT DOCUMENTS

| | | | |
|---|---|---|---|
| DE | 195 00 005 | A1 * | 7/1996 |
| EP | 0 930 114 | B1 | 7/1999 |
| GB | 855495 | A | 11/1960 |
| JP | 61-38769 | A * | 2/1986 |
| JP | 61 38769 | A | 2/1986 |

* cited by examiner

*Primary Examiner*—Kevin P Kerns
(74) *Attorney, Agent, or Firm*—Christensen O'Connor Johnson Kindness PLLC

(57) ABSTRACT

A vent assembly (453) for a high pressure die casting system including a pair of opposed chill blocks (450, 452) having corresponding chill surfaces defining a continuous vent chamber therebetween, each of the chill surfaces comprising a plurality of adjoining chill faces (62, 136, 162, 163, 170) extending the length of the vent chamber, each chill face having a corresponding chill face on the paired chill block defining a section of the vent chamber, the plane of each chill face being oriented at an angle to an adjoining chill face on the corresponding block. Preferably the chill face on a chill block is substantially equidistant from the chill face of the corresponding chill block defining the respective section of the vent chamber.

26 Claims, 15 Drawing Sheets

VENTING ASSEMBLY FOR A CASTING MOULD

FIELD OF THE INVENTION

This invention relates to a venting assembly for a die casting mould and in particular, to a venting system for high pressure die casting systems.

BACKGROUND TO THE INVENTION

In pressure die casting systems, the moulding material is forced under high pressure into the mould. To enable the moulding material to occupy all of the mould, the air in the mould must be evacuated either prior to, or during the material injection step. One problem which occurs particularly in a high pressure die casting (HPDC) process for the production of metal products is that gas is often trapped in isolated regions of the mould. The entrapped gas forms porosity in the castings that can result in rejects and/or make them unsuitable for heat treatment.

A common practice in the industry to eliminate gas entrapment is to apply a vacuum to the mould during cavity filling. In the cold chamber process of HPDC, cavity filling takes place within a few seconds to tens of milliseconds. As effective gas evacuating time is only a few seconds, the amount of gas evacuated will depend upon the efficiency of the vacuum system applied.

A critical component of the vacuum system is a venting system or vacuum valve which opens to apply vacuum to the cavity, and later closes to prevent metal entering the vacuum valve mechanism and the vacuum supply system. The efficiency of the vacuum system depends on the type of vacuum valve used. In a simple vacuum system the valve is shut off before molten metal enters the cavity. During the time after the valve shuts off air can be drawn back into the cavity through parting faces in the die.

Other types of valves such as those of U.S. Pat. No. 5,488,985 assigned to Fondarex S.A. are mechanically closed by the metal pressure built up during the final stages of cavity filling. This type of valve is much more efficient than the simple vacuum system because it can keep extracting gas from the cavity until the cavity is nearly full. However, the die castings are produced under very harsh conditions. This requires the mechanical valve to be precisely manufactured and at the same time be very robust. Any failure of the valve will introduce an additional maintenance cost due to the machine down-time. The mechanical valves which currently serve in the industry are prone to malfunction and also have a high capital cost.

Conventional chill vents are commonly used in the die casting industry to ventilate air from the die cavity without any application of vacuum. Typically a chill vent consists of two halves, each half being a metal block, which are held together to form a thin generally planar gap between the halves. The faces of the chill vent generally have corrugations formed therein to increase the surface area of each face and introduce resistance to the metal flow. Gas can be vented through the gap but metal entering the gap is chilled and solidifies, to eventually block the gap. The metal solidified in the chill vent forms a generally planar washboard-like appendage to the casting.

The thickness of the gap within the chill vent must be small enough to capture and solidify the metal which exits the die cavity at high speed. A typical chill vent has a cross-section thickness of less than 1 mm in depth and 100 mm in width. This small venting area restricts the efficiency of air ventilation. Conventional chill vents have been connected to vacuum to replace the vacuum valve. It was found that the evacuation efficiency was very low, and not sufficient to achieve a sufficiently high vacuum level to produce good quality parts. To improve the evacuation efficiency of a conventional chill vent, it would be necessary to provide a compensating increase in the cross-section area, ie the chill vent has to be made wider. Since the orientation of the planar face of the conventional chill vent is parallel to the die parting face, the increase in the vent width will however accordingly increase the projected area occupied by injected metal in the die, thus increasing the force tending to separate the die parts, and therefore increasing the risk of die flash. As a result, a conventional chill vent can not be effectively used as a vacuum 'valve'.

The document DE19500005 discloses a design of an angled chill vent. Unlike a conventional chill vent, the disclosed apparatus comprises a number of nearly parallel chill vent surfaces positioned substantially perpendicular to the die parting face. Each pair of parallel chill vent surfaces defines a separate vent chamber with each chamber connected to a common runner system. Hence there are a number of separate vent chambers connected in nearly parallel. With this arrangement, the venting area is substantially increased by placing more than one vent in a limited space with an insignificant increase of the projected area. Since the flow of molten metal is terminated in the corrugated gap upon solidification, no mechanical shut off is required and therefore no moving parts are involved.

The present invention provides a venting assembly, which has improved performance by having increased surface area without the usual consequence of an increase in projected area of the die when compared with the conventional chill vent. The vent assembly of the present invention is simple to manufacture, has reduced maintenance costs and reduced downtime when compared with existing vacuum valves.

SUMMARY OF THE INVENTION

In one aspect, the invention provides a vent assembly for a high pressure die casting system comprising

- a vent chamber comprising a plurality of vent sections,
- an inlet for the vent chamber comprising a distribution rail, connecting to the base of each vent section and
- a pair of opposed chill blocks having corresponding chill surfaces defining the vent chamber therebetween, each of the chill surfaces comprising a plurality of adjoining chill faces, each chill face extending the length of the vent chamber, each chill face having a corresponding chill face on the paired chill block defining one of the plurality of vent sections therebetween, the plane of each chill face being oriented at an angle to an adjoining chill face across the width of the respective chill block to define at least one protruding wedge received in a corresponding shaped recess of the pair chill block, the adjoining chill faces forming at least one wedge and recess being joined across the width of the vent chamber.

It is preferable that an adjoining chill face on a respective block is substantially equidistant from the chill face of the corresponding chill block defining the respective section of the vent chamber.

In the context of this invention, the orientation angle of one face with respect to an adjoining face is referenced with respect to the position of the first face. Hence adjoining faces side by side in a common plane are at an orientation of 180°.

In a preferred form of the invention, the orientation of the adjoining chill faces is greater than 90° and preferably equal to or greater than 95° to the adjoining face. This gives the chill blocks a wedge shaped appearance with a single protruding wedge on one chill block being received in a corresponding shaped recess in the other of the paired chill blocks.

The respective chill faces of the chill blocks defining a section of the continuous vent chamber are spaced from one another along the length of the continuous vent chamber. This provides a continuous vent chamber.

The vent assembly comprises a distribution rail extending across the vent chamber, the distribution rail comprising a conduit connecting the base of each section of the continuous vent chamber, such that when the distribution rail is connected to the outlet of the die, the distribution rail is aligned with the parting face of the die. Preferably the distribution rail is integrally formed in the chill blocks.

By having a continuous vent chamber defined by a plurality of paired chill faces oriented at an angle to an adjoining face, pressure forces normal to the paired chill surfaces have only a small resultant component that is normal to the die parting face. In this way, the flow area for removal of air from the die cavity can thus be greatly increased without proportionally increasing the separation forces experienced by the die parts.

In a preferred form of the invention, at least one of the chill blocks comprises a plurality of block modules, each module fitting with an adjoining module and combining with the paired chill block to define a vent section of the vent chamber, the plurality of adjoining modules forming a continuous vent chamber with the paired chill block.

By producing at least one of the chill blocks from a number of modules, the chill vent can be readily assembled and disassembled.

In a further preferred form of the invention, both of the paired chill blocks comprises a plurality of block modules, the modules of each block fitting with an adjoining module and combining with modules of the paired chill block to define a section of the vent chamber, the plurality of adjoining modules of each chill block defining a continuous vent chamber between the pair of chill blocks. The chill faces of the chill blocks preferably have a corrugated surface and the width of the vent chamber is preferably constant along the length of the vent chamber. The vent chamber may be provided with an inlet for connection to the outlet of a high pressure die casting mould. The vent chamber of the chill vent may also be connectable to a vacuum source and is provided with a vacuum port accordingly.

The chill blocks are able to seal against each other so that the vent chamber, and therefore the die cavity, is able to retain a high level of vacuum during cavity filling of molten metal.

In a further preferred embodiment of the invention, the chill blocks are provided with holes for the passage of fluid to control temperature in the chill blocks. These holes which form passages in the chill blocks are connectable to a source of fluid.

A housing may be provided for the chill blocks having a vacuum port connectable to a source of vacuum and connected with the vent chamber between the chill blocks. The housing is also provided with connections to the sources for fluid temperature control and gas blow.

The housing is preferably provided in two parts with each chill block received within each part of the housing. A seal is provided between the two parts of the housing to seal the chill blocks and more specifically the vent chamber from gas leaks.

The chill blocks may further be provided with a pin ejector for assisting with removal of the solidified metal which forms within the vent passage. The pin ejector comprises a depression port and a pin extending from the length of the depression port to the outside of the chill block from the vent chamber. The pin which is biased to extend beyond the interior surface of the vent chamber is depressed to be flush with the surface of the vent chamber. This pin ejector assists with the removal of metal casting from the vent chamber at the time of die opening.

The vent chamber may further be provided with a sealable secondary port. The sealable secondary port being connectable to a source of compressed gas. The compressed gas may be blown into the secondary port to remove or dislodge debris from the vent chamber between cycles of casting production.

The invention further provides an apparatus for forming a solid product from a molten material comprising the vent assembly described above.

In a second aspect, the invention provides an apparatus for forming a solid product from a molten material, the apparatus having a vent assembly, the vent assembly comprising two block structures, a first of said block structures having at least one extending member which engages with at least one corresponding recess in the second block structure, the engaged block structures forming a continuous vent chamber defined between the faces of the extending member and the faces of the corresponding recess of the block structures, the faces of the extending member and corresponding faces of the recess of the block structures defining vent sections of the vent chamber which join across the width of the vent chamber, the vent assembly further comprising an inlet for the vent chamber, the inlet comprising a distribution rail extending the width of the vent chamber connecting to the base of each vent section.

In a preferred form of this aspect, at least one extending member comprises a pair of wedge main faces aligned to each other at a taper angle to form a thin end and a thick end of said wedge-shaped member, a wedge end face extending between the wedge main faces at said thin end of the wedge-shaped member.

The corresponding recess is accordingly a wedge-shaped recess having:

a pair of recess main faces aligned to each other at said taper angle to form a thin end and a thick end of said recess, and a recess end face extending between the recess main faces at said thin end of the recess, Hence the block structures engage such that the wedge main faces oppose corresponding recess main faces and the wedge end face oppose the recess end face, and define a continuous vent chamber therebetween.

Preferably the solid product is formed of metal. Preferably the apparatus is a metal die casting apparatus.

The vent assembly is connectable to a source of vacuum and is used to prevent molten metal ingress into the vacuum system.

The surface of said faces, where said vent chamber is present, may have a corrugated surface. The corrugated surface may have a zigzag or serrated form or may have a sinusoidal form.

The vent assembly preferably includes a fluid temperature control gallery internal to each of said block structures.

A vent assembly according to the present invention differs from a conventional chill vent in that the main faces of the invention are at an angle, rather than parallel, to the die parting face. This more readily allows a limited space to have more than one vent aperture from the die cavity so as to increase the venting area without substantially increasing the die space. Moreover, the increase in the venting area does not increase the projected area of the die, since the main faces of the vent are at an angle to the die parting face. The present invention provides greater flow area for removal of gases from a die cavity.

In another aspect the invention provides a method of casting or moulding a material in a cavity of a die, comprising the steps of:

connecting the cavity to a vent assembly by way of a first conduit, connecting a vacuum source to the vent assembly by way of a second conduit wherein the vent assembly comprises two block structures, the first of the block structures having at least one extending member defining chill faces which engage with a corresponding recess on the second block structure, the engaged block structures forming a vent chamber within the vent assembly, the faces of the extending member and corresponding faces of the recess of the block structures defining vent sections of the vent chamber which join across the width of the vent chamber, the vent assembly further comprising an inlet for the vent chamber, the inlet comprising a distribution rail extending the width of the vent chamber connecting to the base of each vent section;

evacuating gas from the cavity through the first conduit vent assembly and second conduit to the vacuum source;

injecting a quantity of melt of said material into the cavity to fill the cavity, the quantity of metal at least being sufficient to fill the cavity;

permitting a portion of the quantity of the material to flow from the cavity from the first conduit into the vent assembly to solidify the material therein the material flowing into at least the base of each vent section such that the solidified material seals the vent assembly and/or first conduit;

opening the die and vent assembly by separating portions of the die and the vent assembly in a first direction;

ejecting the solidified material from the cavity and the vent assembly.

BRIEF DESCRIPTION OF THE DRAWINGS

In order that the invention may be more fully understood there will now be described, by way of example only, preferred embodiments and other elements of the invention with reference to the accompanying drawings where.

DETAILED DESCRIPTION OF EXAMPLES OF THE INVENTION

Figure 1:
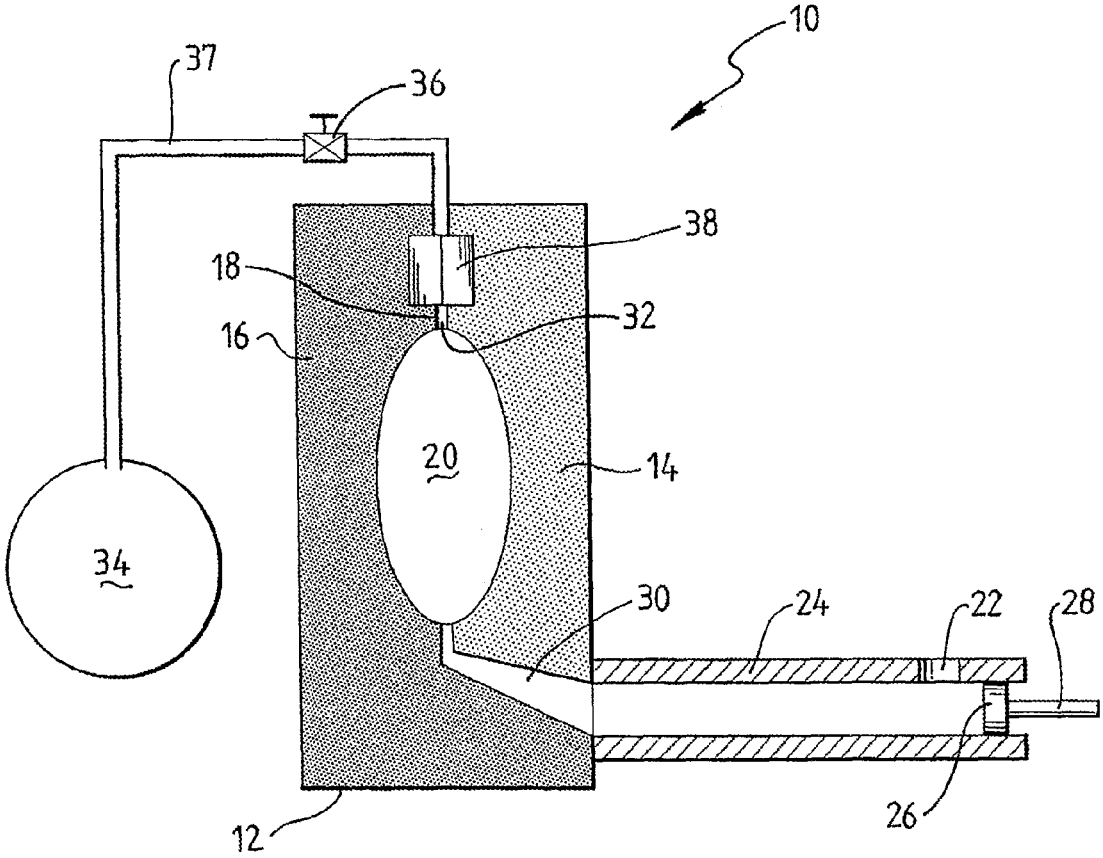
Fig. 1 (PRIOR ART)
FIG. 1 is a simplified representation of high pressure die casting (HPDC) apparatus 10 for the cold chamber process as currently in commercial use.

Referring to FIG. 1, the HPDC apparatus 10 comprises a die 12 comprising a fixed half die 14 and a moving half die 16 which are brought into mutual engagement by fluid actuated rams (not shown). The half dies 14 and 16 separate along a parting face 18. The half dies in engagement form a casting cavity 20 therebetween which has the shape of the product wished to be cast.

Molten metal is introduced to the cavity 20 by means of a high pressure injection system wherein metal is fed through a pour hole 22 into a shot sleeve 24 and a piston 26 on a plunger 28 first closes the pour hole 22 and then, in the same stroke, forces the desired amount of molten metal from the shot sleeve 24 through a runner 30 into the cavity 20. At the opposite end of the cavity a vent hole 32 allows gases and excess metal to escape the cavity.

Before molten metal is introduced to the cavity 20, the air in the cavity is evacuated through the vent hole 32 by means of a vacuum supply in a tank 34 connected to the vent hole 32 by way of a vacuum line 37 containing a solenoid actuated isolating valve 36 and a vacuum valve 38 of one of the types discussed earlier in this specification. For simple vacuum systems the effective evacuating time is only a few seconds and is set by the travel time of the plunger 28 from covering the pour hole to the change-over position.

Figure 6:
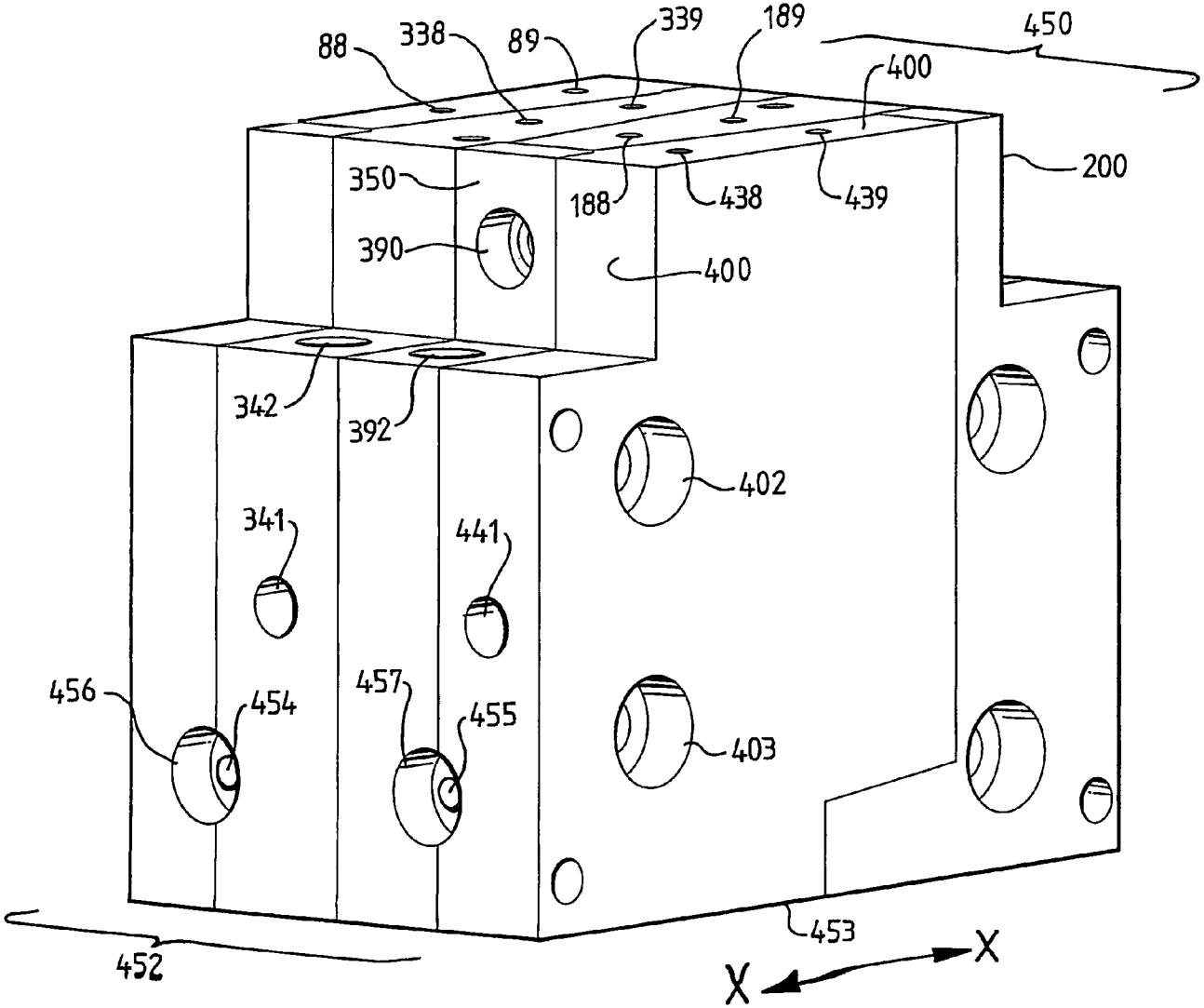
FIG. 6 is a perspective view of a pair of chill block according to FIG. 2 assembled in accordance with the first embodiment of the invention.
Figure 7:
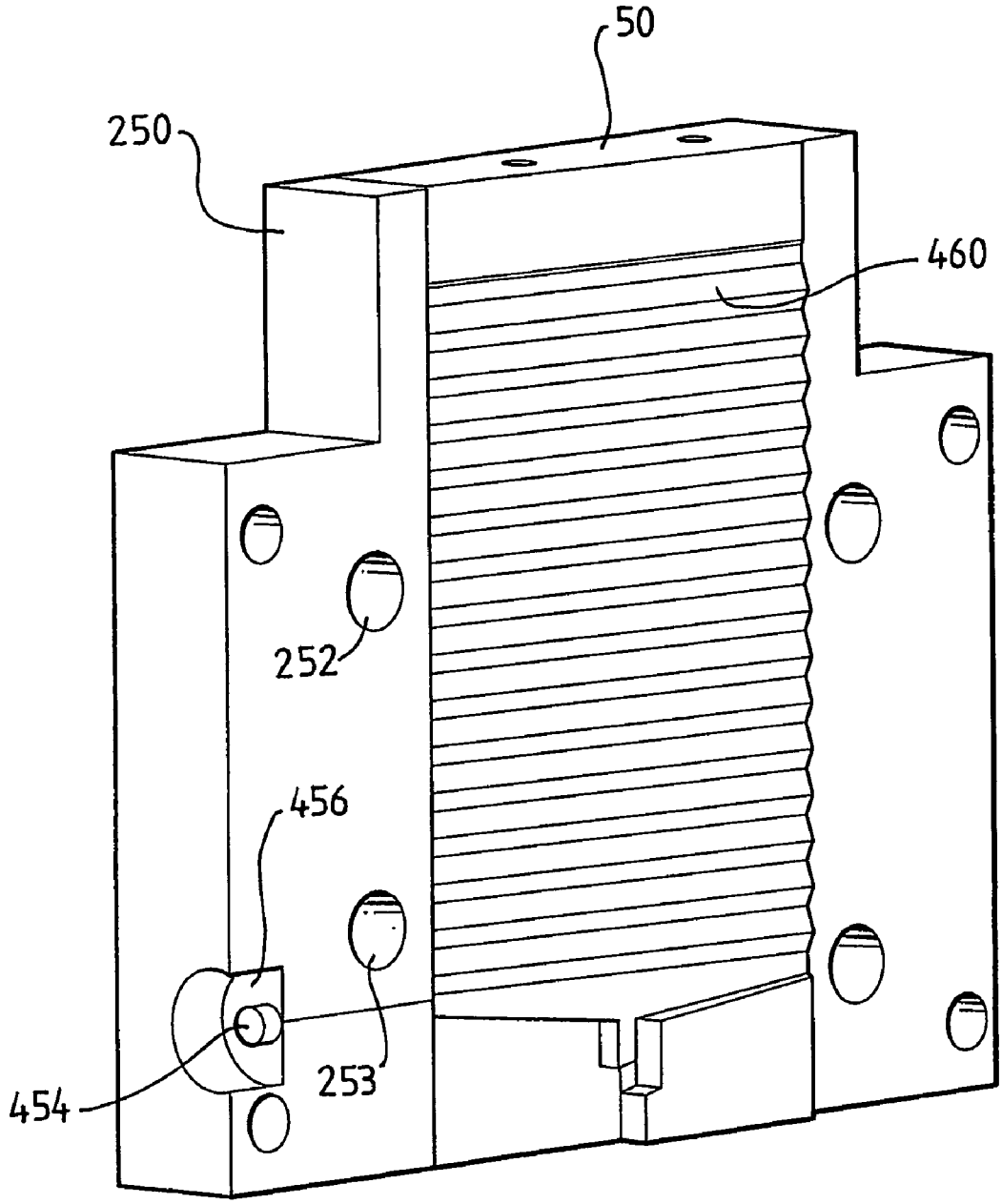
FIG. 7 is a perspective view of opposed first block modules of paired chill blocks of FIG. 6.
Figure 8:
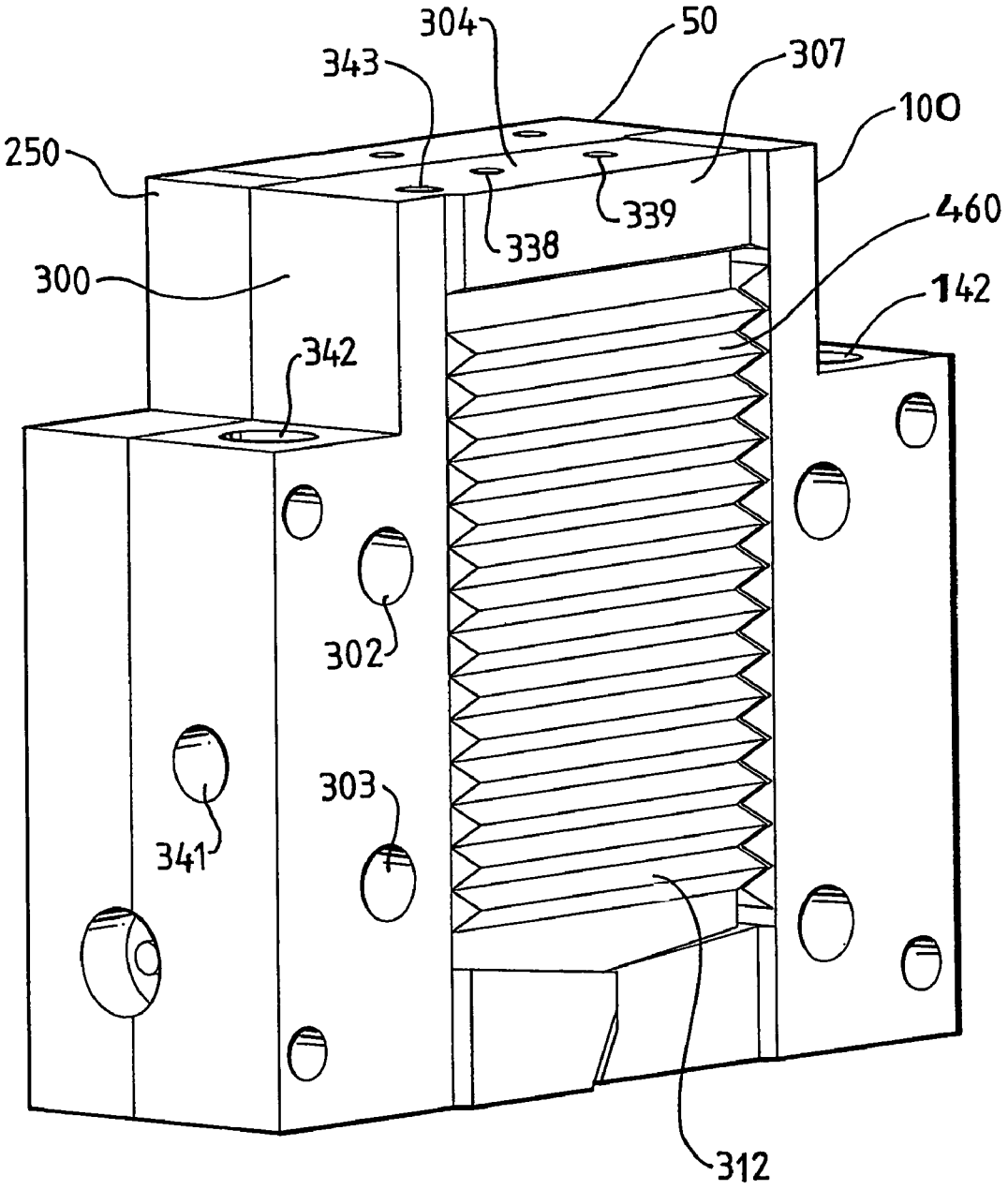
FIG. 8 is a perspective view of opposed first and second block modules of paired chill blocks of FIG. 2.
Figure 9:
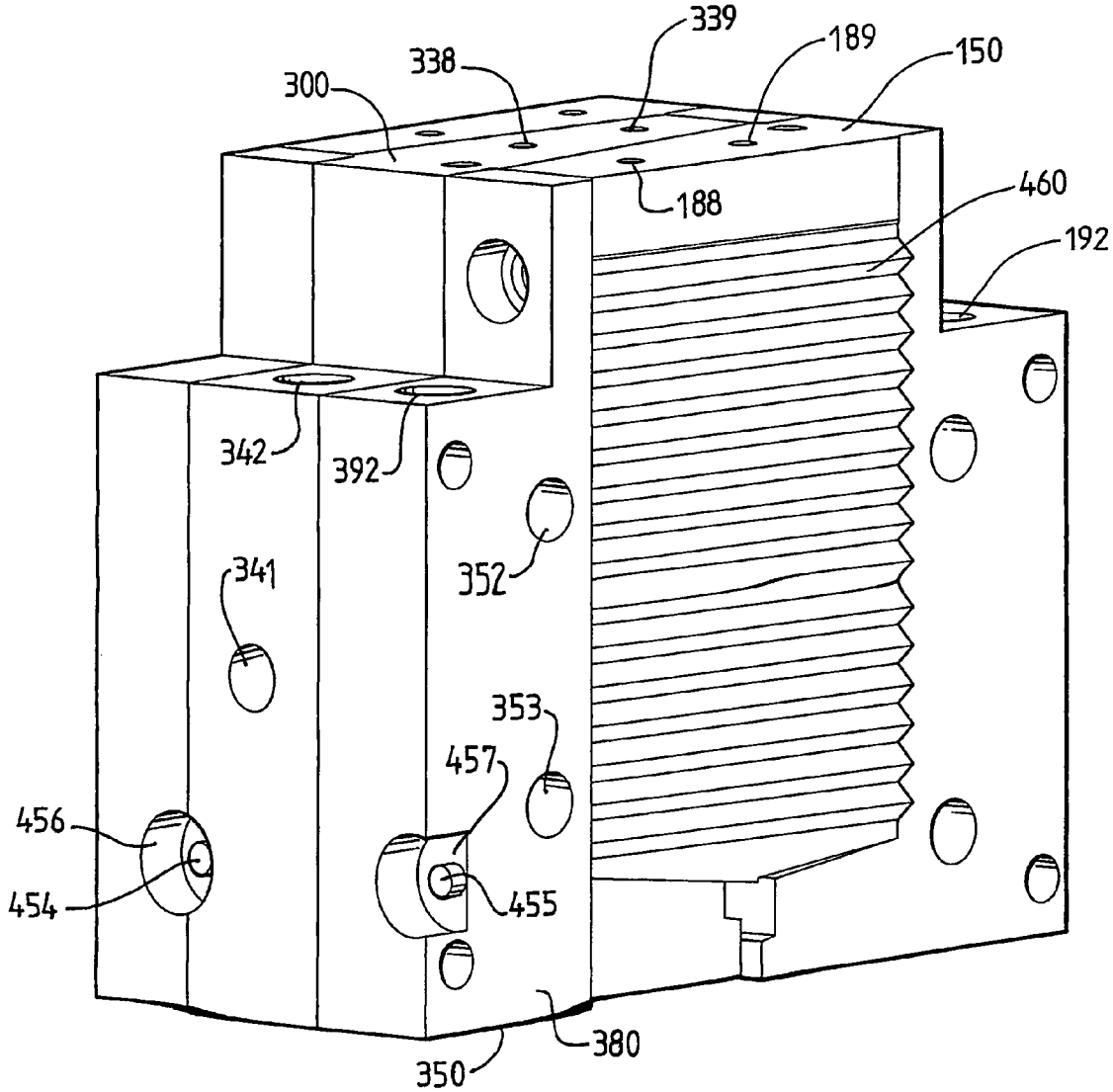
FIG. 9 is a perspective view of opposed first, second and third block modules of pair chill blocks of FIG. 2.

The vent assembly according to one embodiment of the invention is shown in FIG. 6. The vent assembly comprises a first block structure 450 engaged with a second block structure 452. The first block structure is preferably made up of a plurality of modules 50, 100, 150, 200 and the second block structure 452 is made up with second block modules 250, 300, 350, 400. As best shown in FIGS. 6-9, the modules of the first and second block structures are interengaged to form a modular unit. As will become apparent from the detailed description below, the engagement of the paired block structures 450, 452 provides a continuous vent chamber to be formed between the opposed chill surfaces of the block members. Each of the chill surfaces comprises a plurality of adjoining chill faces which interconnect and extends the length of the vent chamber.

As best shown in FIGS. 2-5, the first block structure comprises modules 50, 100, 150 and 200. Each of these modules is in the form of a face plate.

The first main face plate 150 has an L-shaped frame portion 155 and a tapered engagement portion 157. The frame portion 155 has parallel opposed faces 159 and 160 (face 160 being hidden from view in the Figures) by which the plate 150 mates with corresponding parallel faces on neighbouring portion 200 and plate 100 respectively. The extending member portion 157 has a plurality of adjoining chill faces. In the embodiment shown, the extending member is wedge shaped, having a pair of wedge main faces 162 and 163 (face 163 being hidden from view in the Figures) aligned to each other at a taper angle 164 and 165 of about 10° (identified on FIG. 10). The extending member 157 has a thin end 166 at its end face 170 and a thick end 168 where it joins the frame portion 155.

Each wedge main face 162 and 163 has top face portion 172 and 173 respectively, which is flat, and a lower face portion 174 and 175 respectively which carries corrugations 176 having a serrated form (saw tooth cross section) on its surface. Each corrugation 176 extends along its respective face 162 and 163 from the thin end 166 to the thick end 168.

The end face 170 also carries horizontally extending corrugations 184 which each join corresponding corrugations on faces 162 and 163 to create an array of continuous ribs each rib extending across one main face 162, then across the end face 170, then across the other main face 163.

One leg of the L-shaped frame portion 155 forms a substantial fastening portion 180 extending upwards in the illustrations. The other, smaller, leg forms a base portion 182 of the frame portion and extends only halfway along the engagement portion 157.

The first end plate main portion 50 is similar to the first main face plate 150 except that it has an angled and corrugated face 62 on only one side while its opposite face 63 is flat and parallel to faces 159 and 160.

The first narrow face plate 100 has an L-shaped frame portion 105 like the frame portion 155 of plate 150 but, instead of having a tapered engagement portion like portion 157 of plate 150, the first narrow face plate 100 has an end face 136 carrying serrated ripples like those of face 170 of the first main face plate 150.

The second end plate mating portion 200 is similar to the first narrow face plate 100 except that it carries no corrugations and the holes 202 and 203 are recessed to accommodate bolt heads (not shown).

Figure 2:
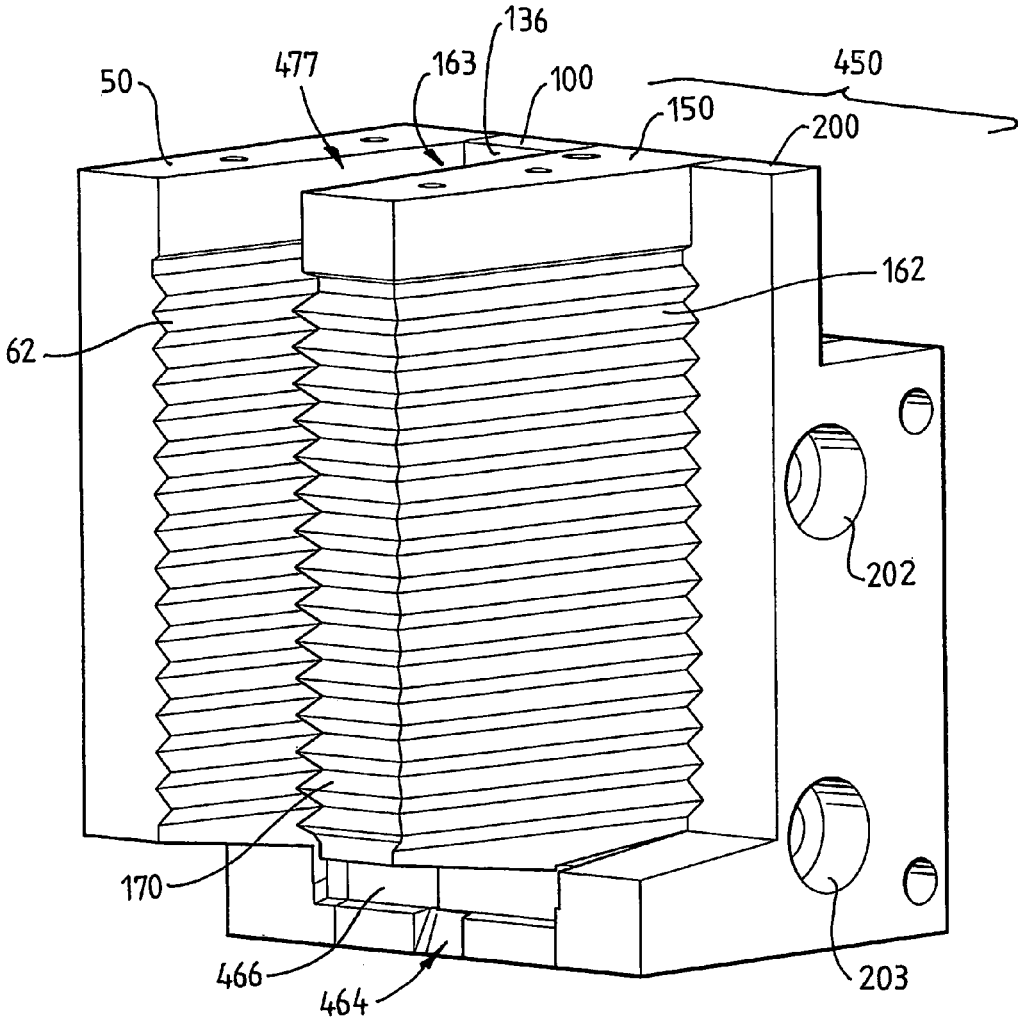
FIG. 2 is a perspective view of a chill block of a venting apparatus according to a first embodiment of the invention.
Figure 4:
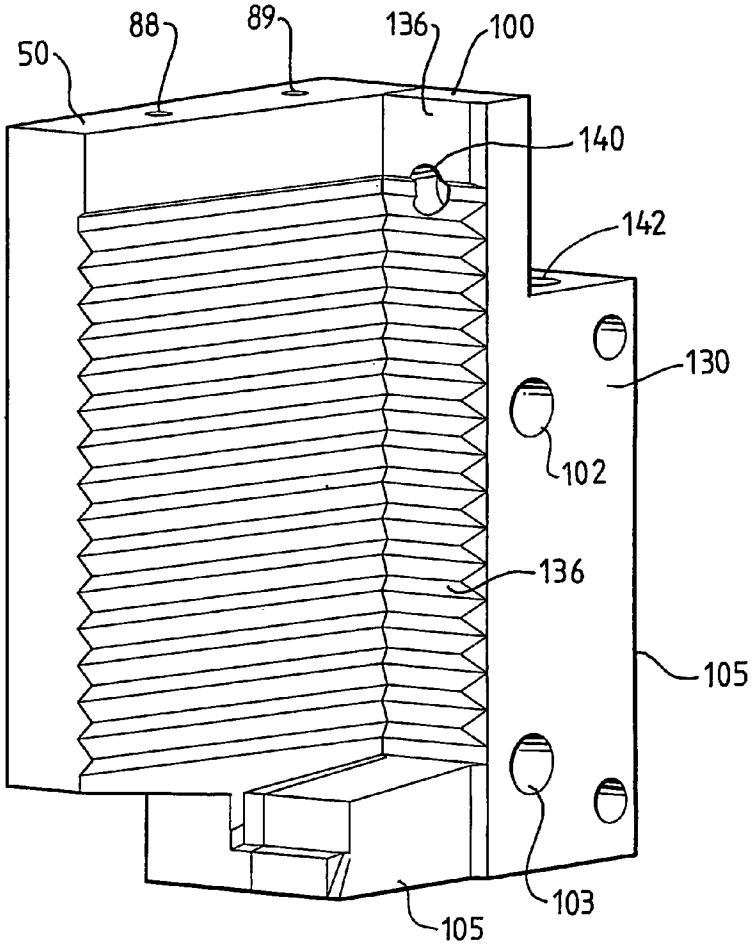
FIG. 4 is a perspective view of the first and second modules of the chill block of FIG. 2.
Figure 3:
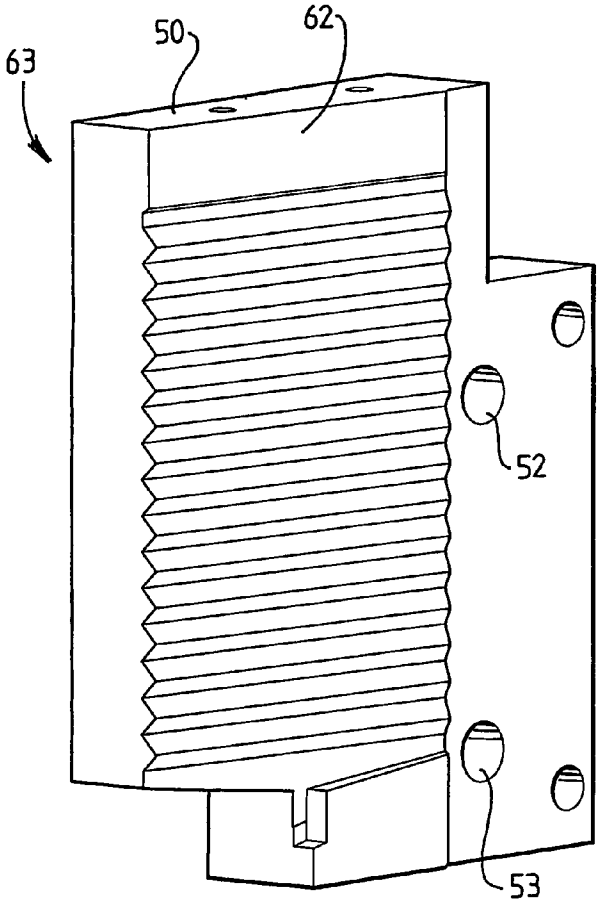
FIG. 3 is a perspective view of a first module of the chill block of FIG. 2.
Figure 5:
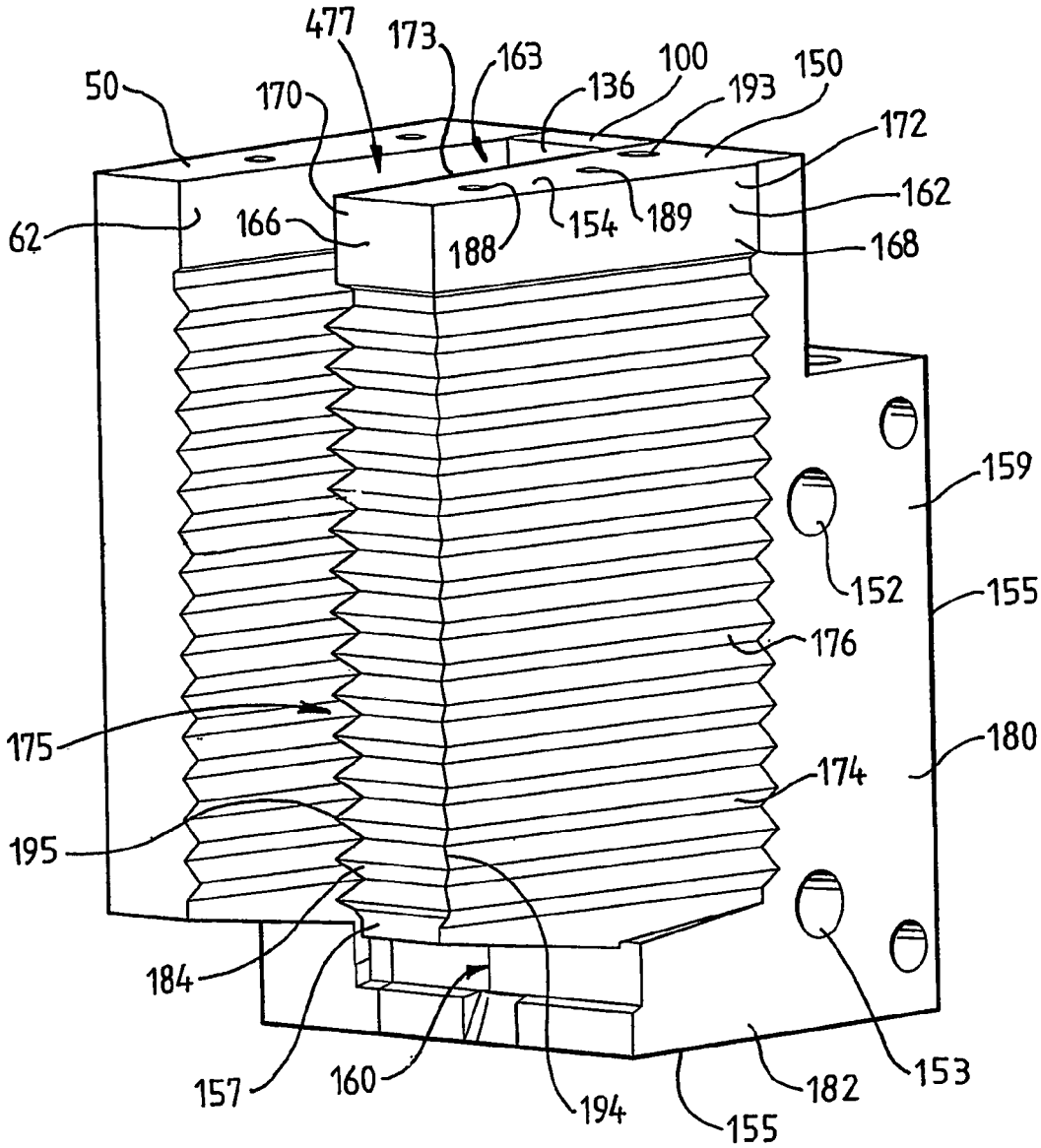
FIG. 5 is a perspective view of the first, second and third modules of the chill block of FIG. 2.

The first end plate main portion 50, the first narrow face plate 100, the first main face plate 150 and the second end plate mating portion 200 are firmly bolted together in the configuration shown in FIG. 2 to create a first block structure 450. A pair of fastening bolts (not shown) for this purpose pass through holes 52, 102, 152 and 202 and through holes 53, 103, 153 and 203 respectively.

As best shown in FIG. 6, the second end plate main portion 400, the second narrow face plate 350, the second main face plate 300 and the first end plate mating portion 250 are substantially the same as the first end plate main portion 50, the first narrow face plate 100, the first main face plate 150 and the second end plate mating portion 200 respectively (although a significant difference is that the corrugations are of opposite phase). They are firmly bolted together by bolts passing through holes 252, 302, 352 and 402 and through holes 253, 303, 353 and 403 respectively to create a second block structure 452.

Two threaded holes 188 and 189 in the top face 154 of plate 150 lead to a gallery for flow of temperature control fluid within the first main face plate 150 and the holes 188 and 189 provide an inlet and outlet respectively for the temperature control fluid. Similar pairs of holes 338, 339, 88, 89, 438 and 439 are provided in plate 300 and portions 50 and 400 respectively. A hole 341, blanked off at its outer end, provides gallery communication between holes 338 and 339. A corresponding blanked-off hole 441 provides communication between temperature control fluid holes 438 and 439, and corresponding holes (not shown) are also provided to link holes 88 and 89 and holes 188 and 189 to form respective temperature control fluid flow galleries.

The block structures 450 and 452 mate together to create a chill vent body 453 in which the extending member portion 307 of the second main face plate 300 is a wedge-shaped member engaged with a wedge-shaped recess 477 formed by opposed faces 62, 136 and 163. Similarly, the extending member portion 157 of the first main face plate 150 is a wedge-shaped member engaged with a wedge-shaped recess formed by opposed faces of plates 300 and 350 and portion 400.

The first block structure 450 is securely fastened to the moving half die of the HPDC apparatus by way of bolts (not shown) extending through holes 142 and 192 in the frame portion 105 and the frame portion 155 respectively. Similarly the second block structure 452 is securely fastened to the fixed half die of the HPDC apparatus by way of bolts (not shown) extending through holes 342 and 392 in the second main face plate 300 and the second narrow face plate 350 respectively. Thus in use, the block structures 450 and 452 separate from each other in the same direction as the die halves separate.

Thus when engaged, the chill faces, the lower corrugated surface portion on wedge faces 62, 136, 163, 162, 170 of the first block structure define one wall of a continuous vent chamber 460. Each of the chill faces 62, 136, 163, 162, 170 has a corresponding chill face on the second block structure to define the opposed wall of the vent chamber. The chill faces of the corresponding modules or face plates are equidistantly spaced over the height of the chill face for that section of the vent chamber. In fact, if the corrugations are ignored, the faces are planar and the chill faces of corresponding modules in a section of the vent chamber are substantially parallel. Hence the width of the vent chamber is substantially the same along its length. As each of the chill faces of the first block structure are at an angle to an adjoining chill face, the vent chamber has a number of interconnected non aligned vent sections extending the length thereof. This orientation ensures that the forces normal to the chill faces exerted by the molten metal, do not all act in the same direction and act against one another to some extent. In fact, components of these normal forces over the length of the vent chamber are in opposite directions and hence act against one and do not act to separate the chill blocks.

While the opposed flat surfaces make a sealing contact when the structures are pressed together, there is a gap between all of the opposed rippled surfaces to provide a convoluted chamber 460 for capture and solidification of metal exiting the die cavity 20.

Holes 140 (FIG. 4) and 390 (FIG. 6) are provided through the fastening portions 130 and 380 of narrow face plates 100 and 350 respectively for connection to a vacuum supply. The holes 140 and 390 open into the upper portion of chamber 460.

Figure 17A:
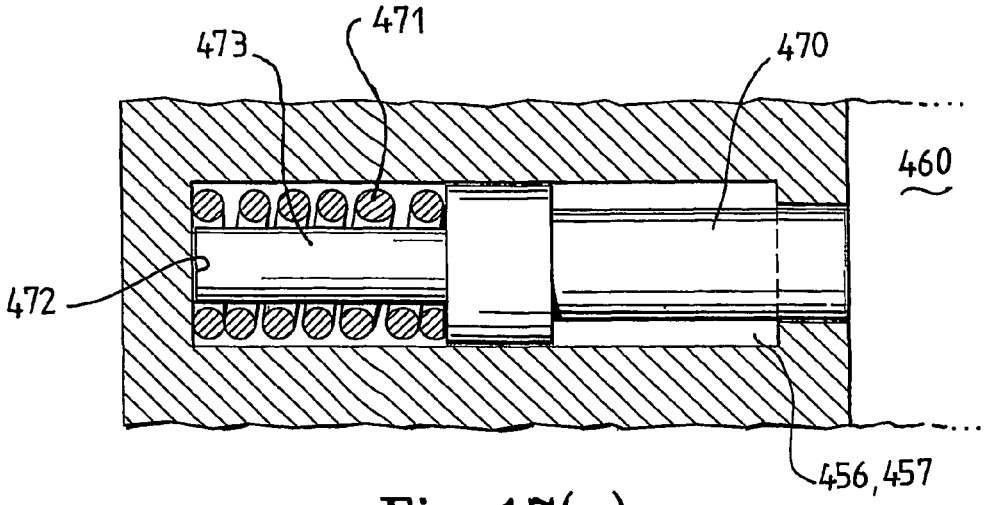
FIGS. 17(*a*) and 17(*b*) illustrate the ejector pin used in an embodiment of the invention.
Figure 17B:
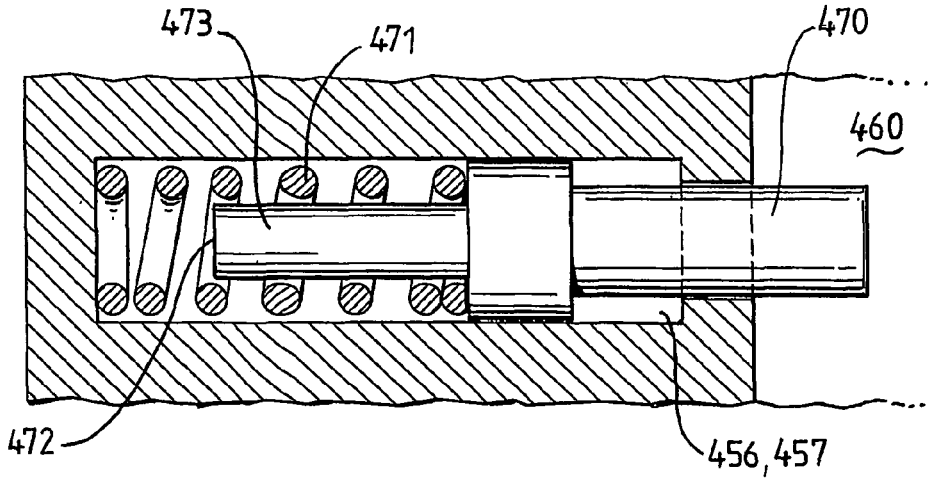

Ejector pins 454 (FIG. 7) and 455 (FIG. 9) are provided in the second block structure 452 to facilitate clean removal of the solidified metal from the chamber 460. As best shown in FIGS. 17(*a*) and 17(*b*), the pins 470 have a hard-stop rod 473 on the back and are actuated by springs 471 which locate into respective sockets 456 and 457. The tip of the pin 455 partially touches the face plate 150 at the engagement portion 157 and partially exposes to chamber 460 when the two blocks 450 and 452 are pressed together. As the molten metal enters the chamber 460 and exerts a force on the pin tip, the base 472 of the hard-stop rod 473 abuts the base of socket 456, 457. In this position, the head of pin 470 is flush with the surface of the vent chamber 460. Once the chill blocks are separated, the pin 470 under the action of spring 471 pushes the solidified metal away from the surface of the vent chamber and returns to its unloaded position shown in FIG. 17(*b*).

A threaded hole 193 is provided in the top face 154 of plate 150, and a threaded hole 343 is provided in the top face 304 of plate 300, whereby lifting means may be attached to facilitate lifting of the chill vent body 453.

The chill vent body assembly 453 (FIG. 6) is positioned in relation to the die in use such that the vent hole 32 of the die is held adjacent the vent inlet 464. The inlet 464 leads to a distribution rail 466 which in turn connects with the lowermost edge of each of the gaps or vent sections.

In use air is evacuated from the vent chamber 460 through the holes 140 and 390 after the two structures are pressed together in engaged contact. The holes 140 and 390 are sufficiently distant from the vent inlet 464 for all the molten metal entering the chamber 460 to solidify before the level of metal reaches the holes 140 and 390.

Figure 10:
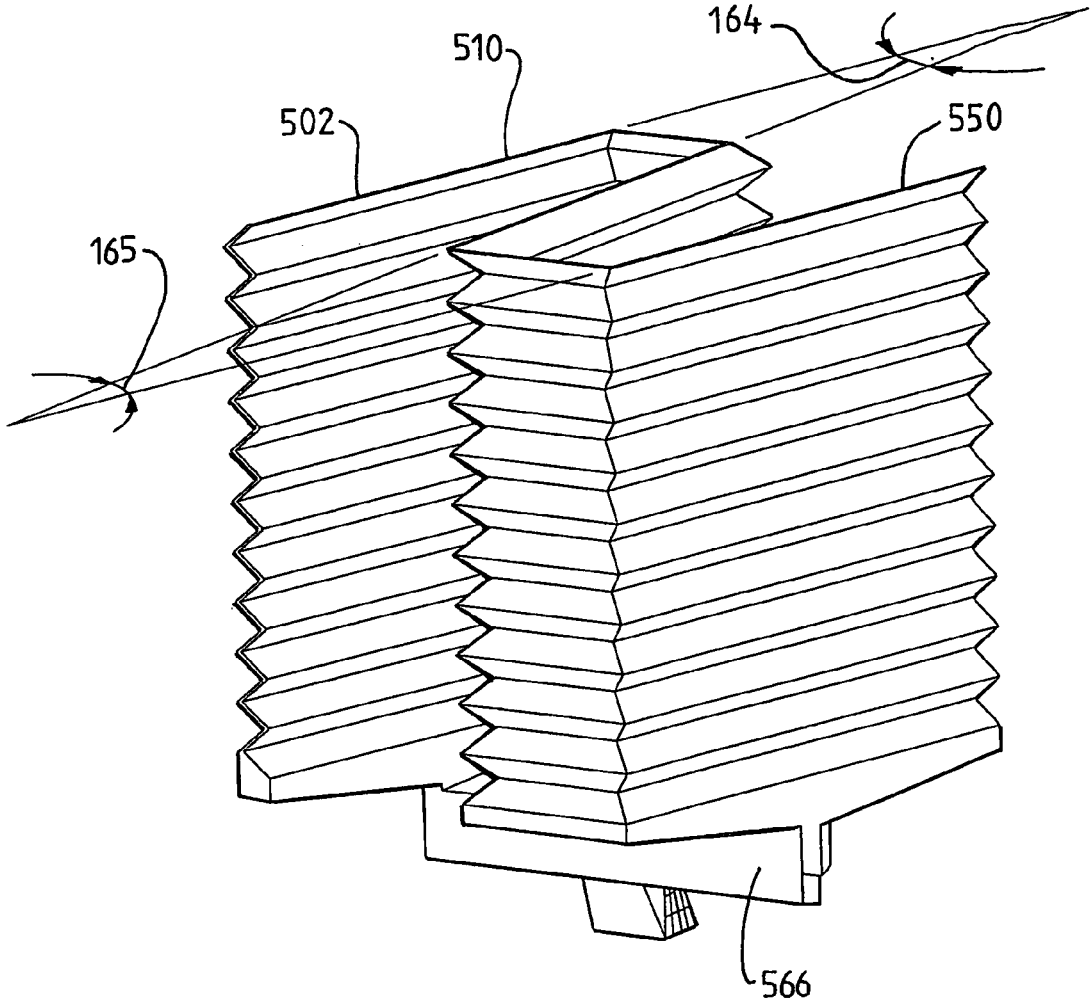
FIG. 10 is a perspective view of a formation 502 that would arise if the gas flow passage within the assembly shown in FIG. 9 is filled with metal, the orientation of the formation being the same as that of FIG. 9.
Figure 11:
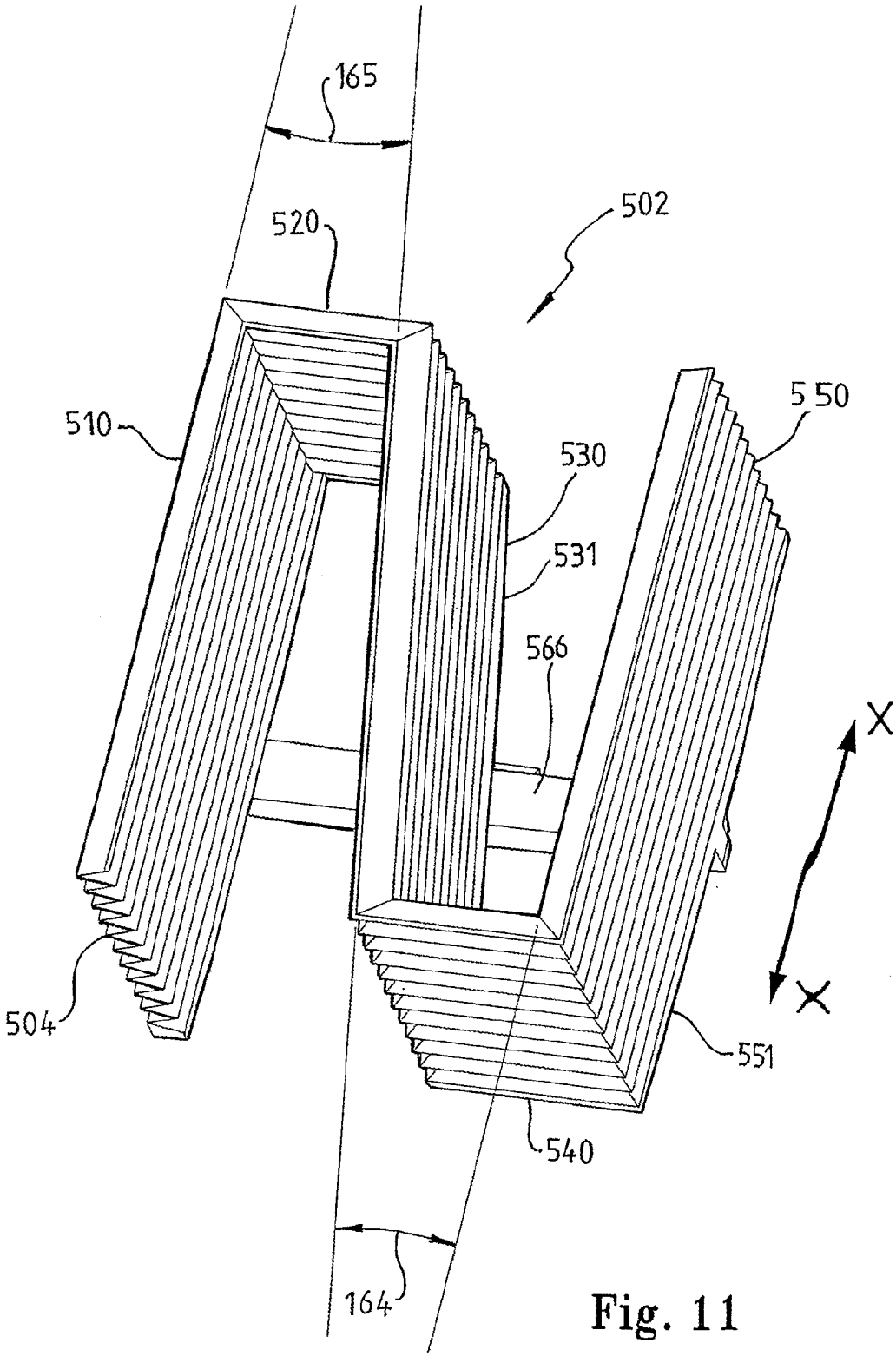
FIG. 11 is a perspective view of the formation 502 as viewed from a more elevated position.
Figure 12:
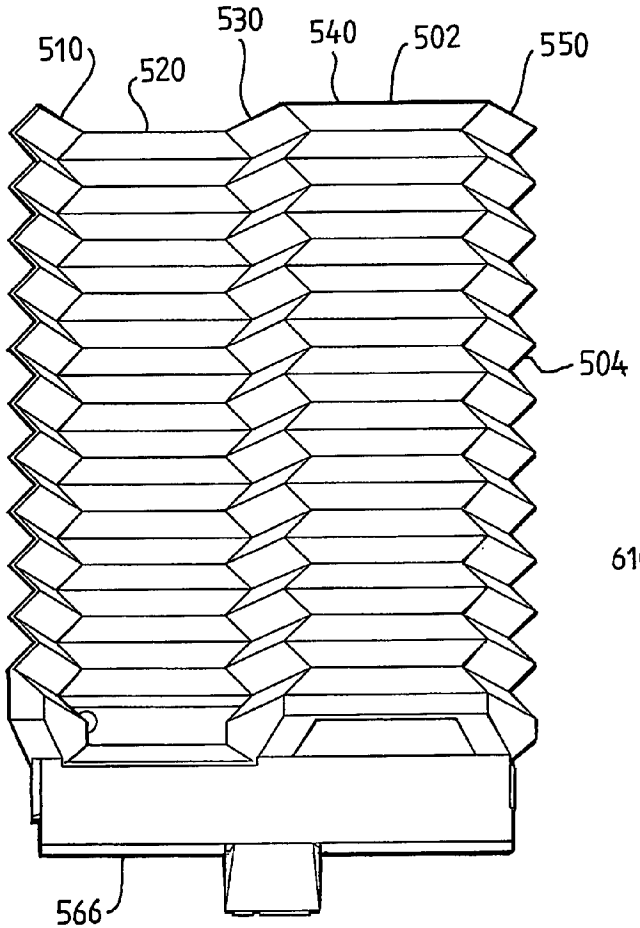
FIG. 12 is a perspective view of the formation 502 as viewed from slightly above horizontal.

The formation 502 shown in FIGS. 10 to 12 illustrates the shape of the convoluted vent chamber 460 and comprises an array 504 of five corrugated panels 510, 520, 530, 540 and 550 arranged sequentially in an edge to edge relationship. Three of the panels, namely panels 510, 530 and 550, are substantially larger than the other two panels 520 and 540 which link them. Panels 510, 530 and 550 are also linked across the centres of their bottom edges 511, 531, and 551 by a distribution runner 566 formed by filling of the distribution rail 466.

Panels 520 and 540 lie parallel to the runner 566 while the panels 510, 530 and 550 are angled at about 95° to panels 520 and 540. The array 504 of panels is thus arranged in an S-shape. Panels 510, 530 and 550 are aligned at an angle of about 5° to the direction (marked X-X on FIGS. 6 and 11) in which the block structures 450 and 452 separate.

The panels 510, 520, 530, 540 and 550 would be formed by filling of the convoluted gap between opposed rippled surfaces on the block structures 450 and 452. For example panel 530 would be formed by filling of the gap between faces 163 and 312 on the first main face plate 150 and the second main face plate 300 respectively.

Figure 13:
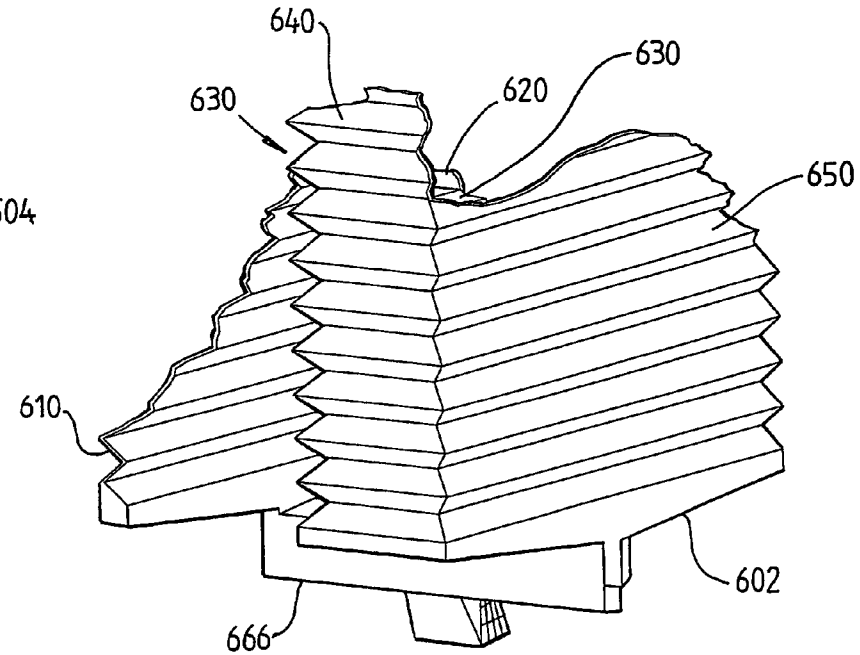
FIG. 13 is a perspective view of a typical formation 602 that is created by metal cooling in the assembly 453 during use.

The formation 602 shown in FIG. 13 is an incomplete version of the formation 502 shown in FIG. 10 and is created because the amount of molten metal which exits from the vent hole 32 in the die is insufficient to fill the vent chamber in the chill vent body, and is thus insufficient to produce the fully formed formation 502. It can be seen that the distribution runner 666 is fully formed (i.e. the same as runner 566 described above) as a result of the distribution rail 466 being completely filled. However metal has only partly filled the panel portions of vent chamber 460, to produce panels 610, 620, 630, 640 and 650 which are incomplete versions of panels 510, 520, 530, 540 and 550 as the top portions are missing.

Surface coatings may be applied to the corrugated surfaces in order to improve their performance. Suitably a titanium nitride coating may be provided to prevent metal and other material sticking to the corrugated surfaces. It can also manipulate thermal transfer between the chill blocks and solidifying metal and is expected to increase the life of the chill face surface. Additionally the roughness of the corrugated surfaces may be enhanced in order to improve their performance.

It has been found from tests that when this vent assembly is connected to a vacuum system with a vacuum tank 34 and solenoid valve 36, at least the same or even better evacuation efficiency than a conventional vacuum valve can be achieved. This is because:

- the invention provides an increased cross sectional flow area (horizontal plane in FIG. 6) for a given gap between the two halves of the vent which enables more air to be extracted from the die;
- the gas flow passage is open until the end of the cavity fill; and
- the cross sectional flow area of a vent may be readily tailored to any particular application by adding an appropriate number of paired main face plates and narrow face plates in a modular manner.

Another advantage of the above-described vent is that the geometry leads to all the metal which solidifies in the vent being joined together enabling easier and more reliable ejection with less problems from separate pieces stuck in the vent.

Since the flow passage is shut off by the solidified metal, there is no need for any additional moving parts to act as a mechanical vacuum valve. Thus the present invention is a more robust device which is particularly advantageous because such mechanical vacuum valves are difficult to maintain in the HPDC process.

This invention thus has advantages over both the conventional chill vent and the vacuum valves currently used in the die casting industry.

A device in accordance with the first embodiment was trialled in a production machine of a die casting plant. The part was an aluminium pump cover, which has a complicated geometry shape. The part was usually produced with a commercial vacuum system, by which the vacuum valve is covered by U.S. Pat. No. 5,488,985 and was regarded as the commercially best on the market. The commercial valve fails at least once a day in this particular casting machine. The valve in accordance with the first embodiment was tested in the machine and consistently ran for six days without failure. This proved the robustness of the invented device. The casting quality produced in the trial has been checked. It has achieved the same quality as that from the normal production. Sensors were installed in the machine to monitor the performance of the invented device. The same level of vacuum in the die cavity was achieved in the trial as when using the commercial valve.

Figure 14:
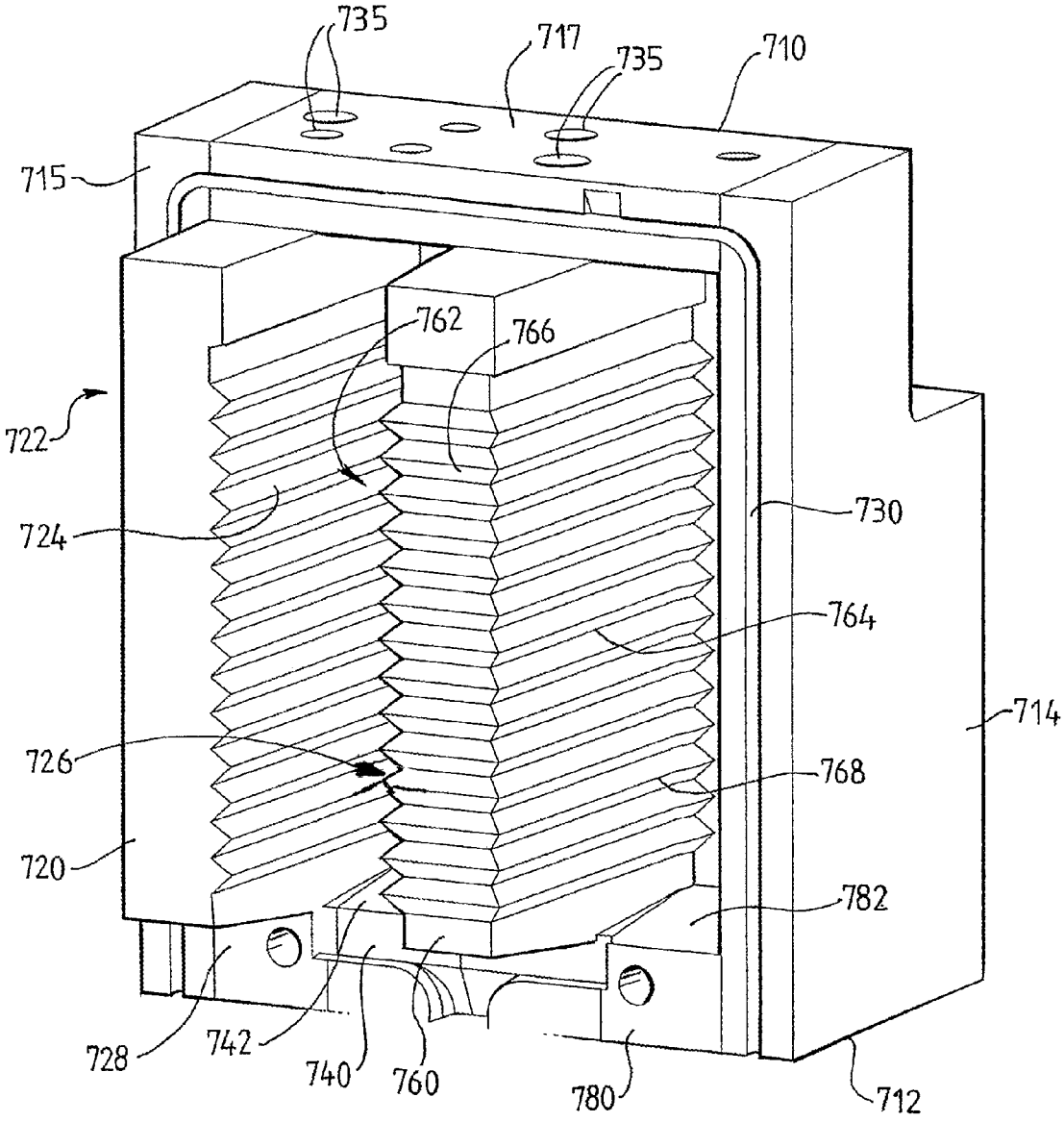
FIG. 14 is a perspective view of an assembly forming part of a chill vent apparatus according to a second embodiment of the present invention.
Figure 15:
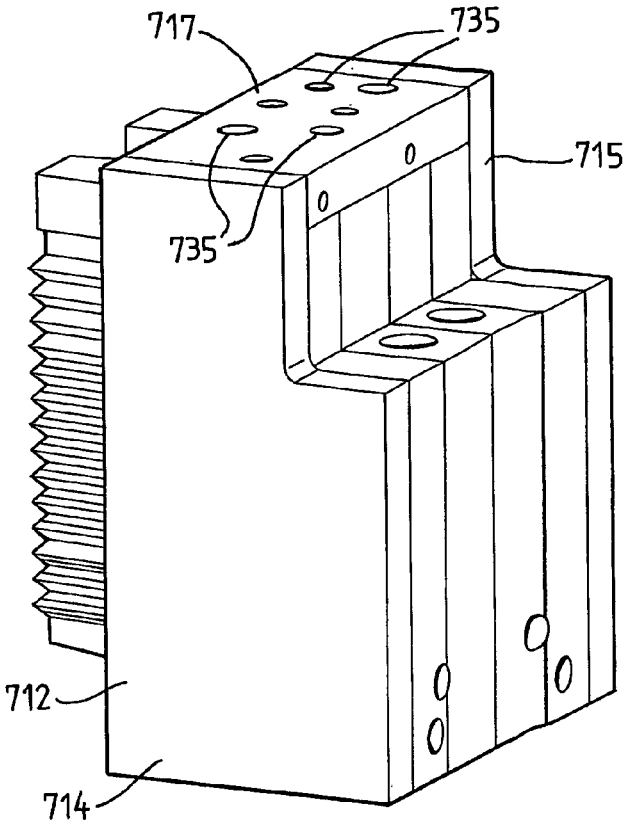
FIG. 15 is a rear perspective view of the embodiment of FIG. 14.
Figure 16:
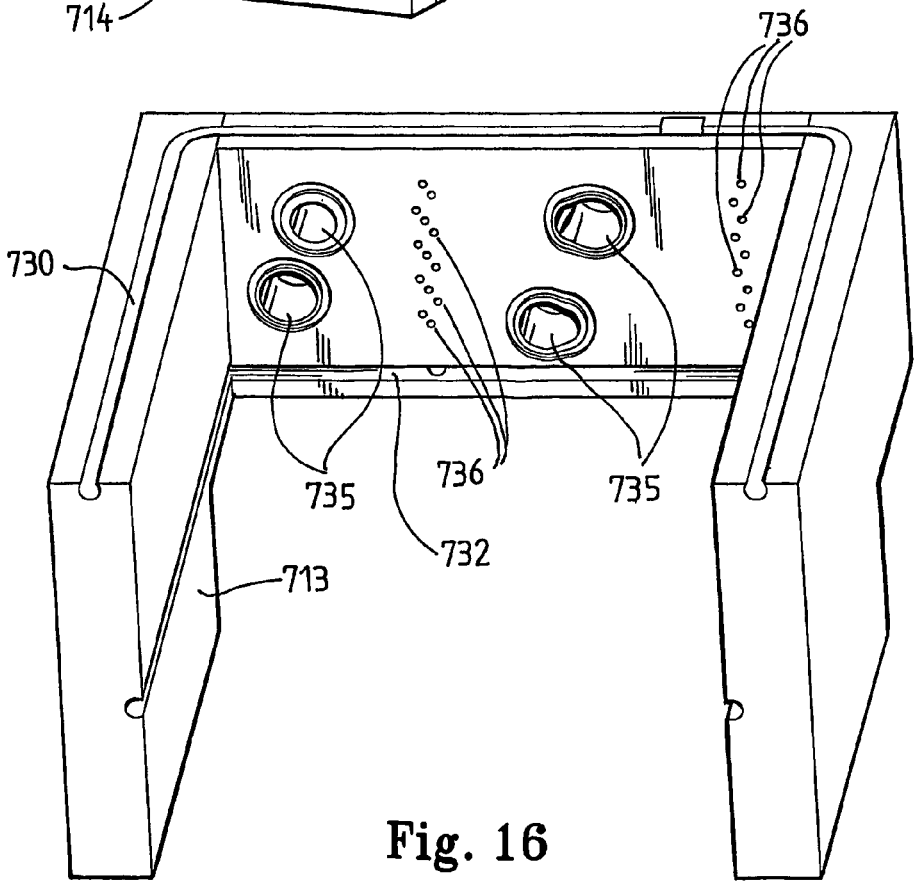
FIG. 16 is a perspective view of the cover shown in FIG. 14.

A further embodiment of the invention is shown in FIGS. 14-16. The embodiment provides a chill vent apparatus having two block structures brought together much as described above in relation to the first embodiment, but which adds a case 712 around the block structures and improves the sealing between the two blocks. The two block structures are generally the same. The block 710 has a surrounding case 712 fabricated from steel and having a rectangular box-like configuration with an open face. Four inserts (namely an endplate main portion 720, a narrow face plate 740, a main face plate 760 and a plate mating portion 780) are bolted together as described above and the case 712 is bolted onto its block structure. The case 712 includes end walls 714, 715 and top section 717.

The main face plate 760 is located towards the centre of the inserts. It is tapered in the manner of the tapered extending member portion 157 described above. Wedge faces 762 and 764 on respective obverse sides of the insert 760 each carry an array of corrugations 768. The end face 766 is also provided with corrugations thereon and in this respect is substantially the same as the tapered extending member portion 157 of the first embodiment.

The endplate main portion 720 has an angled corrugated face 724 on one main face and a flat main face 722 on the obverse side. Its end face does not have corrugations thereon. The flat main face bears snugly against an end wall 713 of the case 712 and the corrugated face 724 is angled at about 5° to the flat main face 722.

The narrow face plate 740 is angled on its top face 742 to engage with a mating block.

The end plate mating portion 780 has a flat face on its side bearing against the end wall 714 of the box, and is angled on its top face 782 to engage with downwardly facing face 728 on a mating block.

When two blocks 710 are mated together for use, angled faces 724, 762, 764 and end faces 766 and 726 form a continuous vent chamber.

The case 712 provides a flat shut off face when the two blocks are brought together, while the first embodiment of this invention as described above relies on three angled faces (172, 173 etc) and four flat faces to shut off, which is very difficult from engineering point of view. The case is further provided with seal grooves 730, 732 extending around the end walls 714, 715 and top section 717. The grooves are made with an undercut. Rubber strips (not shown) are embedded into the groove. The rubber in the groove 730 perfectly seals the gap when the two blocks are pressed together. The rubber strip in the groove 732 seals the air leak between the bolted inserts (720, 740, 760 and 780) and the case 712. The bore holes 735 enable temperature control fluid pipes (not shown) threaded to the holes 88, 89 and 188, 189 as described above to pass through the case 712 to connect to the temperature control fluid source.

A significant benefit of using a case 712 to contain the components is that it can serve to reduce air leakage into the chamber 460 when vacuum is applied.

During use, dust (a mixture of lubricant and metal flash) is generated in the casting process and sticks to the corrugated surface of the chill faces. This build up of dust over time blocks the passage of gas flow and thus decreases venturing efficiency. Air blow is integrated into the top section 717 of the case 712. The gas blow comprises of the nozzle holes 736, the distribution chamber (hidden from the surface of the drawing and its end is shown by the two small holes at the rear of 717 in FIG. 15 and is blocked off at the end), and the threaded holes (the holes next to 735) connecting to the air source.

Figure 18:
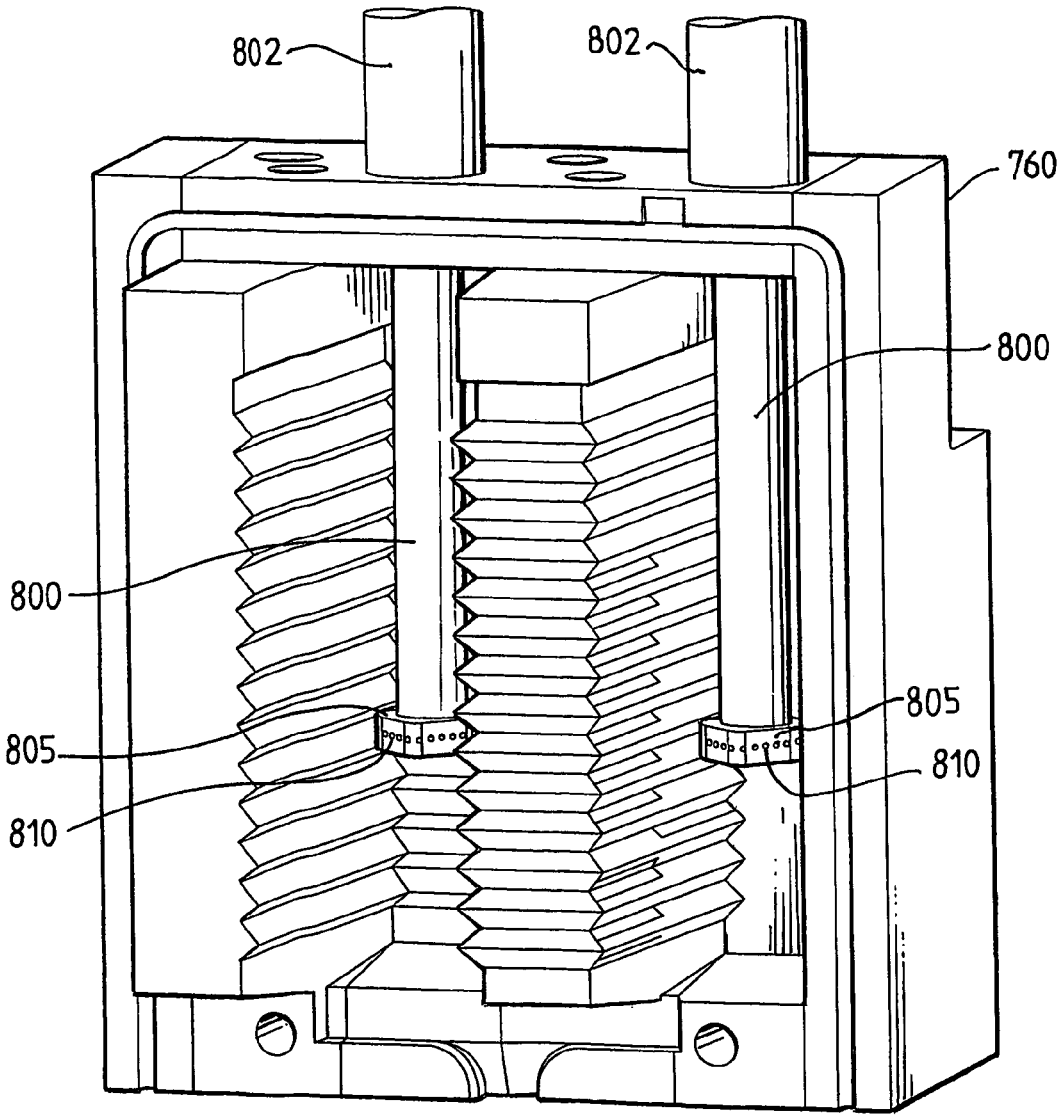
FIG. 18 illustrates a dust removal adaption of a further embodiment of the invention.

In the embodiment shown in FIG. 18, the dust holes are replaced by extendible dust nozzles 800 which extend into the recess of the chill blocks. These nozzles are extendible by a means such as adjusting the gas pressure in the nozzle tube and allow gas to be blown through outlets 810 in nozzle head 805 to any position on the chill faces to remove the dust mentioned above. When not in use, nozzles may be bias by a spring in sleeve 802 to return to a retracted position either against or within case 760.

Whilst the above description includes the preferred embodiments of the invention, it is to be understood that many variations, alterations, modifications and/or additions may be introduced into the constructions and arrangements of parts previously described without departing from the essential features or the spirit or ambit of the invention.

For example, although the embodiments described above have the chill vent connected to a vacuum, the use of a vacuum is not essential. The chill vent may be used without a vacuum connection and testing has shown that in such a configuration the chill vent is 3 to 4 times more efficient than a conventional chill vent.

Also, the embodiments described have a taper angle 164 and 165 of about 10° but the exact angle is not particularly important providing the block structures 450 and 452 fit together neatly and the draft angle is sufficient to reliably achieve ejection of the formation 502. The wedge shape is not even limited to a sharp angle. Furthermore angles 164 and 165 could be different to each other.

The end faces 136 and 170 are described as having corrugations covering them completely. However these faces may carry corrugations on only some or even none of their surfaces.

The corrugated end faces 136 and 170 have been described as substantially planar, and joining the wedge main faces (eg. faces 162 and 163) at respective edges 194 and 195. Alternatively the end faces (such as end face 170) may be curved, and may be cured so far that they blend, into the main faces (eg. faces 162 and 163) without or with minimal edges 194 and 195.

The corrugations may be any convenient shape but an abrupt zigzag formation has been found to be particularly suitable.

The blocks 450, 452 and 710 described all have many components requiring assembly. The invention envisages those blocks (or their equivalents) being made as a single unitary item.

The present invention may act as a valve when vacuum is applied or may act as a vent when no vacuum is applied, even for the same configuration.

Some embodiments of the invention do not have a gap between the wedge end face and the slot end face so that in the solidification chamber corresponding to chamber 460 no panel portions are produced which are parallel to the runner 666.

It will be also understood that where the word "comprise", and variations such as "comprises" and "comprising", are used in this specification, unless the context requires otherwise such use is intended to imply the inclusion of a stated feature or features but is not to be taken as excluding the presence of other feature or features.

The reference to any prior art in this specification is not, and should not be taken as, an acknowledgment or any form of suggestion that such prior art forms part of the common general knowledge in Australia.

The invention claimed is:

1. A vent assembly for an apparatus for forming a solid product from a molten material, the vent assembly comprising a vent chamber comprising a plurality of vent sections, an inlet for the vent chamber comprising a distribution rail, connecting to the base of each vent section and a pair of chill blocks having corresponding chill surfaces and being arranged in opposition to define the vent chamber therebetween, each of the chill surfaces comprising a plurality of longitudinally adjoining chill faces, each chill face extending the length of the vent chamber, each chill face having a corresponding chill face on the paired chill block defining one of the plurality of vent sections therebetween, the plane of each chill face being oriented at an angle to an adjoining chill face across the width of the respective chill block to define at least one protruding wedge received in a corresponding shaped recess of the paired chill block, the adjoining chill faces forming at least one wedge and recess being joined across the width of the vent chamber.

2. The vent assembly of claim 1, wherein at least one of the chill blocks comprises a plurality of block modules, each block module fitting with an adjoining module and combining with the paired chill block to define a section of the vent chamber, the plurality of adjoining modules forming a continuous vent chamber with the paired chill block.

3. The vent assembly of claim 1, wherein both of the paired chill blocks comprise a plurality of block modules, the modules of each block fitting with an adjoining module and combining with modules of the paired chill block to define a section of the vent chamber, the plurality of adjoining modules of each chill block defining a continuous vent chamber between the pair of chill blocks.

4. The vent assembly of claim 1, wherein the chill faces of the chill blocks have a corrugated surface.

5. The vent assembly of claim 1, wherein the width of the vent chamber is constant along the length thereof.

6. The vent assembly of claim 1, wherein the vent chamber is provided with an inlet that is connected to the outlet of a cavity in which the product is formed, such that when the inlet is connected to the cavity, the distribution rail is aligned with a parting face about the cavity.

7. The vent assembly of claim 1, wherein the vent chamber is provided with a vacuum port and is connectable to a vacuum source.

8. The vent assembly of claim 7, wherein the chill blocks are able to seal against each other so that the vent chamber and a cavity in which the product is formed retain vacuum during filling of the cavity with molten material.

9. The vent assembly of claim 1, wherein the chill blocks are provided with holes for the passage of fluid to control the chill blocks' temperature, the holes being connectable to a source of temperature control fluid.

10. The vent assembly of claim 1, wherein a housing is provided for the chill blocks, the housing having a vacuum port connectable to a source of a vacuum and communicating with the vent chamber between the chill blocks.

11. The vent assembly of claim 10, wherein the housing is provided in two parts, each part receiving a respective chill block.

12. The vent assembly of claim 11, wherein a seal is provided between the two parts of the housing to seal the chill blocks within the housing.

13. The vent assembly of claim 1, wherein the chill blocks are provided with a pin ejector for assisting with the removal of solidified metal from the vent passage.

14. The vent assembly of claim 13, wherein the pin ejector comprises a depression port and a pin extending the length of the depression port, the pin being biased to extend beyond the interior surface of the vent chamber and being able to be depressed flush with the surface of the vent chamber.

15. The vent assembly of claim 1, wherein the vent chamber is further provided with a sealable secondary port, the sealable secondary port being connectable to a source of compressed gas.

16. An apparatus for forming a solid product from a molten material comprising a cavity, in which the product is formed, and the vent assembly of claim 1.

17. The vent assembly of claim 1, wherein the chill faces are provided with a surface coating to improve the performance of the surface.

18. The vent assembly of claim 1, wherein the apparatus for forming a solid product from a solid material is a high pressure die casting system.

19. An apparatus for forming a solid product from a molten material, the apparatus having a vent assembly, the vent assembly comprising two block structures, a first of said block structures having at least one extending member which engages with at least one corresponding recess in the second block structure, the engaged block structures forming a continuous vent chamber defined between the faces of the extending member and the faces of the corresponding recess of the block structures, the faces of the extending member and corresponding faces of the recess of the block structures defining vent sections of the vent chamber which join across the width of the vent chamber, the vent assembly further comprising an inlet for the vent chamber, the inlet comprising a distribution rail extending the width of the vent chamber, said distribution rail connecting to the base of each vent section.

20. The apparatus of claim 19, wherein at least one extending member of the vent assembly comprises a pair of wedge main faces aligned with respect to each other at a taper angle to form a thin end and a thick end of said wedge shaped member, a wedge end face extending between the wedge main faces at said thin end of the wedge shaped member.

21. The apparatus of claim 20, wherein at least one corresponding recess comprises a wedge shaped recess having a pair of recess main faces aligned with respect to each other at said taper angle to form a thin end and a thick end of said recess, a recess end face extending between the recess main faces at said thin end of the recess.

22. The apparatus of claim 20, wherein the block structures engage such that the wedge main face opposes corresponding recess main faces and the wedge end face opposes the recess end face to define a continuous vent chamber therebetween.

23. The apparatus of claim 19, wherein the vent assembly is connectable to a source of vacuum.

24. The apparatus of claim 19, wherein the surface of the faces of the extending member and the recess are corrugated.

25. The apparatus of claim 19, wherein the vent assembly includes a temperature control fluid gallery internal to each of the block structures.

26. A method of casting or moulding a material in a cavity of a mould or die, comprising the steps of:

connecting the cavity to a vent assembly by way of a first conduit, connecting a vacuum source to the vent assembly by way of a second conduit, wherein the vent assembly comprises two block structures, the first of the block structures having at least one extending member defining chill faces which engage with a corresponding recess on the second block structure, the engaged block structures forming a vent chamber within the vent assembly, the faces of the extending member and corresponding faces of the recess of the block structures defining vent sections of the vent chamber which join across the width of the vent chamber, the vent assembly further comprising an inlet for the vent chamber, the inlet comprising a distribution rail extending the width of the vent chamber connecting to the base of each vent section;

evacuating gas from the cavity through the first conduit vent assembly and second conduit to the vacuum source;

injecting a quantity of melt of the said material into the cavity to fill the cavity, the quantity of melt at least being sufficient to fill the cavity:

permitting a portion of the quantity of the material to flow from the cavity from the first conduit into the vent assembly to solidify the material therein such that material flows into at least the base of each vent section and the solidified material seals the vent assembly and/or first conduit;

opening the mould or die and the vent assembly by separating portions of the mould or die and the vent assembly;

ejecting the solidified material from the cavity and the vent assembly.

* * * * *